US006479386B1

(12) United States Patent
Ng et al.

(10) Patent No.: US 6,479,386 B1
(45) Date of Patent: Nov. 12, 2002

(54) PROCESS FOR REDUCING SURFACE VARIATIONS FOR POLISHED WAFER

(75) Inventors: Kan-Yin Ng, Maryland Heights, MO (US); Yun-Biao Xin, St. Peters, MO (US); Henry Erk, St. Louis, MO (US); Darrel Harris, Kirkwood, MO (US); James Jose, Wentzville, MO (US); Stephen Hensiek, Foley, MO (US); Gene Hollander, Wentzville, MO (US); Dennis Buese, O'Fallon, MO (US); Giovanni Negri, Sizzano (IT)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

(21) Appl. No.: 09/505,269

(22) Filed: Feb. 16, 2000

(51) Int. Cl.[7] ..... H01L 21/302

(52) U.S. Cl. ..... 438/692; 216/88; 451/389; 451/460; 451/41; 451/53; 451/7

(58) Field of Search ..... 451/364, 389, 451/460, 41, 53, 7; 438/692, 693; 216/88, 89

(56) References Cited

U.S. PATENT DOCUMENTS

| | | | | |
|---|---|---|---|---|
| 3,170,273 A | | 2/1965 | Walsh et al. | 51/281 |
| 3,475,867 A | | 11/1969 | Walsh | 51/281 |
| 3,492,763 A | | 2/1970 | Walsh | 51/277 |
| 3,970,494 A | | 7/1976 | Pritchard | 156/155 |
| 3,979,239 A | | 9/1976 | Walsh | 156/4 |
| 4,316,757 A | * | 2/1982 | Walsh | 156/286 |
| 4,512,113 A | | 4/1985 | Budinger | 51/236 |
| 5,256,599 A | | 10/1993 | Asetta et al. | 437/225 |
| 5,494,849 A | | 2/1996 | Iyer et al. | 437/63 |
| 5,571,373 A | | 11/1996 | Krishna et al. | 156/636 |
| 5,605,487 A | | 2/1997 | Hileman et al. | 451/5 |
| 5,770,522 A | | 6/1998 | Bronson | 438/692 |
| 6,004,405 A | | 12/1999 | Oishi et al. | |

FOREIGN PATENT DOCUMENTS

| | | |
|---|---|---|
| JP | 63200951 | 8/1988 |
| JP | 02-277235 | * 11/1990 |

OTHER PUBLICATIONS

May 31, 2001 Search Report from European Patent Office.

* cited by examiner

*Primary Examiner*—George Goudreau
(74) *Attorney, Agent, or Firm*—Senniger, Powers, Leavitt & Roedel

(57) ABSTRACT

A process for forming a semiconductor wafer which is single side polished improves nanotopology and flatness of the polished wafer. The process reduces the effect of back side surface features, such as edge ring phenomena and back side laser marks, on nanotopology, thereby improving oxide layer uniformity for chemical/mechanical planarization (CMP) processing, and flatness on the polished front side of the wafer after polishing. The wafer is mounted on a polishing block by wax. The edge ring causes certain deformation and stress in the wafer upon mounting, which is held by the wax. After mounting, the wax is heated to allow the wafer to relax, removing the stress, without degrading the bond of the wafer to the polishing block. The wafer is polished and removed from the polishing blocks. The polished surface substantially retains its shape after being de-mounted from the block.

37 Claims, 4 Drawing Sheets

PROCESS FOR REDUCING SURFACE VARIATIONS FOR POLISHED WAFER

BACKGROUND OF THE INVENTION

This invention relates generally to polishing semiconductor wafers and more particularly to single side polishing semiconductor wafers to improve nanotopolgy and flatness so as to minimize thickness variations in a thin dielectric layer thickness.

The continued drive for miniaturization of electronic devices printed on semiconductor substrates places increasing technical demands on device manufacturers, and also suppliers of semiconductor wafers on which the devices are imprinted. Miniaturization is reaching the stage where circuit line widths are decreased beyond present levels, into ranges below 0.25 microns. It is well documented that decreasing the line width decreases the amount of acceptable deviations of the surface of the wafer from being perfectly flat. Semiconductor wafers, including any layers deposited on the surface of the wafer, must be particularly flat in order to print circuits on them by, for example, an electron beam-lithographic or a photolithographic process. Wafer flatness in the focal point of the electron beam delineator or optical printer is important for uniform imaging in the electron beam-lithographic and photolithographic processes. The flatness of the wafer surface directly impacts device line width capability, process latitude, yield and throughput. The depth of focus of the electron beam delineator or optical printer limits the amount of local elevational variation in the wafer surface topology which is permitted.

However it has not been as well documented, until recently, that as line widths are reduced additional problems arise related to the topology of a single (front) surface of the wafer. Devices are built up on the semiconductor substrate in numerous (e.g., 10 to 20) layers. As the line widths decrease, they become relatively tall in relation to their width. This makes it difficult to keep the built up line generally perpendicular to the wafer surface. To reduce this effect, layers are being applied with a lesser thickness. In particular, the insulating oxide (dielectric) layer has been significantly reduced in thickness. Another change to device manufacture is that it has become necessary to use chemical/mechanical planarization (CMP) on the front surface of the wafer between application of certain layers in order to maintain flatness. However, CMP decreases the thickness of the layer applied prior to CMP. Features on the surface of the wafer to which the oxide layer is applied can give rise to discontinuities in dielectric layer thickness. Where the layers are particularly thin, polishing can reduce the thickness to the point where current leakage occurs, causing failure of that part of the wafer and concomitant loss of yield.

Differences in surface elevation in the range of just 100 nanometers can cause problems with oxide layer thickness during device manufacture. One source of these discontinuities is the edge ring phenomena. Etching processes cause peripheral rings on the front and back surfaces of the wafer to form. Conventional single side polishing is not capable of removing these edge rings. Application of the oxide layer to the front surface is done with the wafer in a free state, i.e., it is not held by a vacuum chuck so that the edge ring causes the thickness of the oxide layer to be less over the edge ring than elsewhere. The thickness of the layer is further reduced when CMP is performed on the oxide layer. Because of the oxide layer is particularly thin, even a slight discontinuity in the front surface of the wafer can cause the oxide layer to be so thin after CMP that current leakage occurs and that area of the wafer fails.

In order to identify and address these problems, device and semiconductor material manufacturers are now considering the nanotopology of the front face of the wafer. Nanotopology has been defined as the deviation of a wafer surface within a spatial wavelength of about 0.2 mm to 20 mm. This spatial wavelength corresponds very closely to surface features on the nanometer scale for processed semiconductor wafers. The foregoing definition has been proposed by Semiconductor Equipment and Materials International (SEMI), a global trade association for the semiconductor industry (SEMI document 3089). Nanotopology measures on the elevational deviations of one surface of the wafer and does not consider thickness variations of the wafer, as with traditional flatness measurements. Edge rings are one of the features which most profoundly affect nanotopology, including particular oxide layer uniformity in the CMP process (see, K. V. Ravi, "Wafer Flatness Requirements for Future Technology", Future Fab International, July, 1999). Several metrology methods have been developed to detect and record these kinds of surface variations. For instance, the measurement deviation of reflected light from incidence light allows detection of very small surface variations. These methods are used to measure peak to valley (PV) variations within the wavelength Etching is not the only source for producing undesired surface features. Wafer producers often use identification marks on the silicon wafers to track them through the various wafering processes. In this manner, different marks can be used to indicate different wafer characteristics, identify the source of defective wafers or otherwise trace the origin of a particular wafer or lot of wafers. For example, a series of laser-scribed dots (also referred to as hard marking) may be used to form an identification number on a surface of a wafer. Lumonics sells a number of suitable dot matrix machines under the trademark WaferMark® for hard marking identification marks on silicon wafers with a laser. Laser marks on the back surfaces of wafers tend to leave corresponding bumps on the front sides of the wafers after polishing. These bumps can affect not only oxide layer thickness when the oxide layers are subjected to CMP, but also flatness.

SUMMARY OF THE INVENTION

Among the several objects and features of the present invention may be noted the provision of a process of forming semiconductor wafers which have a high degree of flatness on one side of the wafer; the provision of such a process which reduces variations in the thickness of a dielectric material on the one side of the wafer; the provision of such a process which facilitates the imprinting of extremely narrow width lines for manufacturing smaller IC devices on the wafer; the provision of such a process which reduces dielectric layer non-uniformity caused by formation of an edge ring on the wafer during prior processing of the wafer; the provision of such a process which reduces degradation in flatness and dielectric layer uniformity caused by laser marks on the back side of the wafer; the provision of such a process which reduces stress in the wafer caused by wax mounting of the wafer to a polishing block for polishing; and the provision of such a process which is readily executed using existing process equipment.

A process of forming semiconductor wafers which inhibits the formation of surface features on a polished front side of the wafer side generally comprises slicing a wafer from an ingot of semiconductor material. At least one side of the wafer is etched to remove damage. Wax in flowable form is applied to a mounting surface of the polishing block and a back side of the semiconductor wafer is pressed into the wax on the polishing block in a vacuum pressure environment to bond the wafer to the polishing block. Pressing the wafer into the wax against the polishing block moves the wafer from a relaxed configuration to a deflected configuration. The wafer as bonded to the polishing block is heated to a temperature and for a time selected to soften the wax and permit the wafer to move relative to the polishing block toward the relaxed configuration without breaking the bond of the wafer to the polishing block thereby to relieve stress in the wafer. The front side of the wafer as mounted on the polishing block by holding the polishing block and rubbing the front side of the wafer against a polishing pad in the presence of a polishing slurry. The polished wafer is removed from the polishing block and cleaned.

A process substantially set forth above includes marking the back side of the wafer with a laser mark is also disclosed. Etching is not required in this other aspect of the invention.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
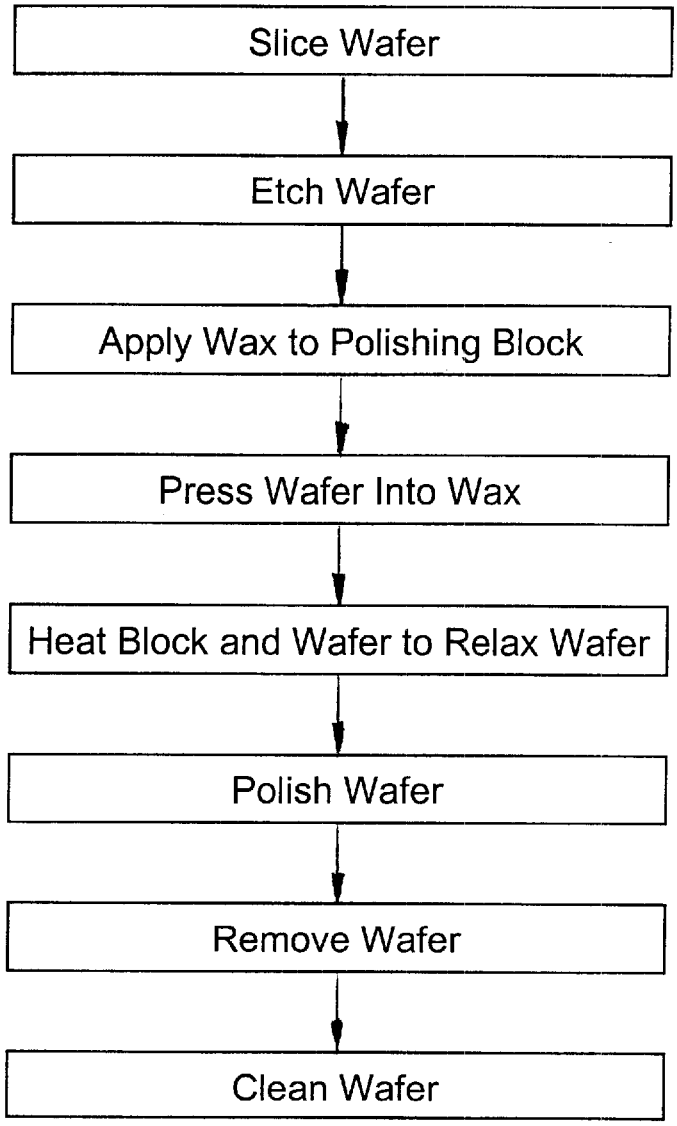
FIG. 1 is a block diagram showing a process of forming semiconductor wafers of the present invention.

A process of forming semiconductor wafers of the present invention inhibits the formation of surface features on a polished front side of each wafer. Semiconductor material for the wafers may be made in a conventional fashion. In a typical production process, semiconductor material is formed according to the Czochralski method in which highly pure polycrystalline silicon is melted in a crucible. A monocrystalline seed crystal is brought into contact with the melted polycrystalline silicon and then withdrawn so that material from the melt freezes on and around the seed crystal. The seed crystal is drawn up to a desired length to form a generally cylindrical ingot of monocrystalline semiconductor material. The ingot is trimmed to a more precisely cylindrical shape and a flat is formed along its length. Wafers are sliced from the ingot in a suitable manner and then cleaned to remove debris. Preferably slicing by a wire saw is employed to minimize damage to front and back sides of the wafer, although conventional internal diameter saws could also be employed. Subsequent processing of the wafer is conducted to form at least one highly flat, highly reflective, substantially damage free surface. A process of the present invention is illustrated in block diagram form in FIG. 1. There are several variations in the processing, including the addition of steps, subsequent to slicing which are well known to those of ordinary skill in the art, and it is to be understood that these variations are intended to be alternative embodiments of the invention.

Typically the wafers are thinned and planarized following slicing by lapping. Lapping is performed on both sides of the wafers to obtain a more precise thickness, to remove the non-uniform damage left by slicing and to attain parallelism and flatness. If lapping is done in a single step, an identifying laser mark is applied just prior to lapping. In some cases, the laser marks are applied to the back sides of the wafers. The thickness of the wafers following lapping is slightly greater than the final thickness, because the thickness is decreased during subsequent steps such as etching and polishing. Other thinning and/or planarizing procedures may be employed, such as grinding or even double side polishing. Lapping still leaves the front and back sides of the wafers with damage which must be removed. Cleaning after lapping removes particulates on the wafer but damage on the sides remains.

Chemical etching is used after lapping to remove damage. Etchants in routine use typically contain a strong oxidizing agent, such as nitric acid, dichromate, or permanganate, a dissolving agent, such as hydrofluoric acid, which dissolves the oxidation product, and a diluent such as acetic acid. The relative proportion of these acids which produces the smoothest and most uniform etching, however, is one at which the removal rate is still relatively high. To minimize nonuniformity, therefore, the wafers are rotated as they are etched. However, it has been found that the removal rate is not entirely uniform. As a result, a raised ring is left at the peripheral edges of the front and back sides of the wafer.

The wafer is now ready for single side polishing, such as by an automated polishing apparatus shown in co-assigned U.S. Pat. No. 5,605,487. It is to be understood that other polishing apparatus may be used, including those which are not fully automated, without departing from the scope of the present invention. A ceramic polishing block 10 (FIG. 3) is cleaned and taken to a location for application of wax onto the block. A suitable wax is dissolved and applied to a mounting surface of the block 10 as the block is rotated so that the wax is spread uniformly in a thin layer 12 over the mounting surface. Wax is preferably applied in a thickness from about 2–15 microns. The block 10 and wax layer 12 are then heated at atmospheric pressure to promote evaporation of solvent used to liquify the wax.

The heated polishing block 10 is taken to a vacuum press (not shown) for mounting the wafer on the mounting surface of the polishing block. The polishing block 10 is received in a chamber of the vacuum press so that the mounting surface having the thin layer 12 of wax thereon is facing downward. A semiconductor wafer 14 is also placed in the chamber at a location below the polishing block 10, preferably prior to placement of the polishing block in the chamber. The wafer 14 is placed so that its back side faces upwardly toward the mounting surface of the polishing block 10. The chamber is sealed and a pump is operated to reduce the pressure in the chamber below atmospheric to a level which will eliminate air bubbles beneath the wafer 14 or reduce them to an acceptably insubstantial size or degree when the wafer is mounted on the polishing block 10. For example, the pressure may be reduced to 0 to 3 torr. The press is activated to push the polishing block 10 down onto the wafer 14 so that the wafer is pressed into the wax and secured to the polishing block. The force of the press is sufficient to elastically deform the wafer 14, and in particular the edge ring tends to be substantially flattened. In addition, depressions on the front surface of the wafer 14 are formed opposite the laser marks on the back side by the pressure of the press. The wax bonds to and holds the wafer 14 in the deformed configuration, and the stress in the wafer caused by the act of pressing the wafer onto the polishing block 10 is maintained. The process for wax mounting at a vacuum pressure is generally the same as disclosed in co-assigned U.S. Pat. No. 4,316,757, although the '757 patent discloses the mounting of multiple wafers to a carrier, rather than the mounting of a single wafer 14 to a single polishing block 10 as described herein.

Figure 3:
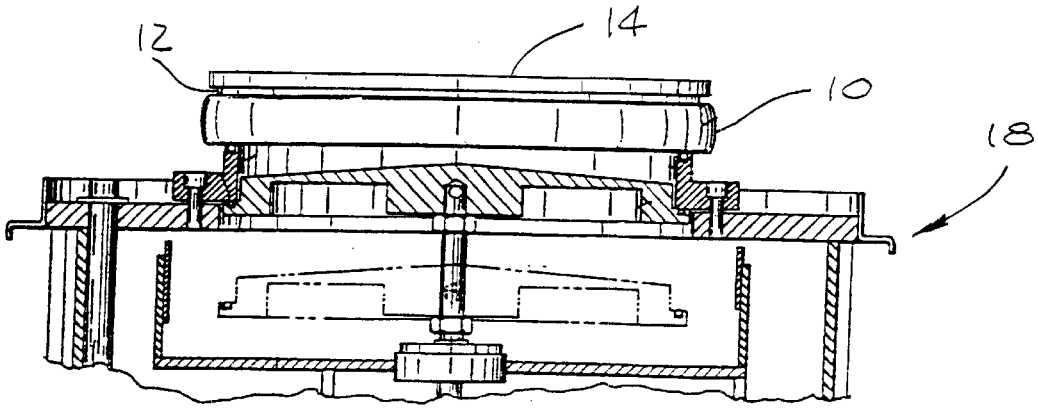
FIG. 3 is a fragmentary, sectional view of a steam pot for heating a polishing block and wafer mounted by wax on the polishing block.

Atmospheric pressure is restored in the vacuum press, which is then opened. The wafer and polishing block unit, generally indicated at 16, is removed from the vacuum chamber and taken to a heating station (not shown). In the automated polishing machine described in U.S. Pat. No. 5,605,487, the wafer and polishing block unit 16 is returned to the same station where the polishing block 10 and wax were heated just prior to placement in the vacuum press. A fragmentary portion of a steam pot (generally indicated at 18) for heating the wafer and polishing block unit 16 is shown in FIG. 3. The steam pot 18 is set so that the wax is preferably heated to about 50° C. to 150° C., more preferably to about 80° C. to 95° C., and most preferably to about 85° C. The temperature of the steam pot 18 is preferably about 95° C. During testing, the temperature of the wax was taken to be the temperature of the back side of the wafer which contacts the wax. The heating preferably occurs for a period of between 5 and 300 seconds, more preferably between 10 and 90 seconds, still more preferably between 45 and 60 seconds, and most preferably for about 50 seconds. The wax is preferably maintained at about 85° C. for at least about 40 seconds of the total heating period. Heating in this range causes the wax to soften to the extent that the stress in the wafer 14 caused by the deformation described hereinabove upon mounting of the wafer to the polishing block 10 can be relieved by micro-motion of the wafer relative to the polishing block. The stress relief occurs without loss of a bond of the wafer 14 to the polishing block 10.

Figure 4:
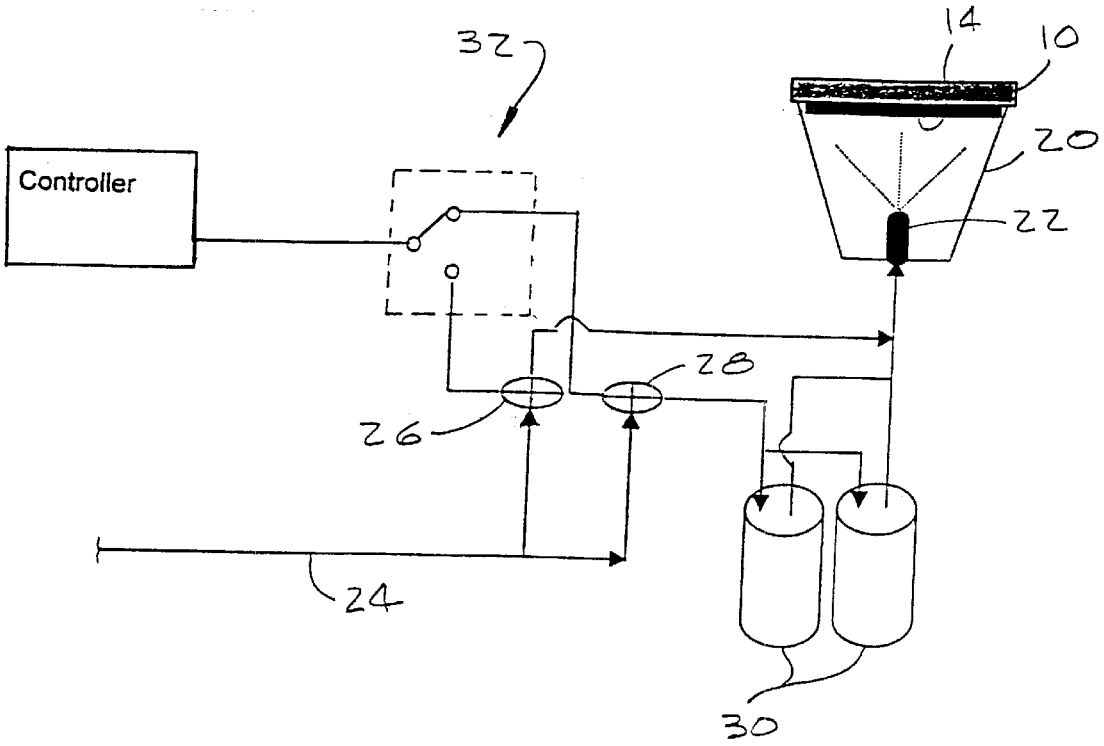
FIG. 4 is an alternative embodiment water spray for heating the polishing block and wafer.

It is to be understood that the times and temperatures for re-heating the wax may be different than described without departing from the scope of the invention. For instance, the material properties of the wax, polishing block and the wafer may require different times. In every case, the temperature and duration of re-heating will be such as to permit relaxation of stress without loss of the bond between the wafer and the polishing block. Moreover, other apparatus for re-heating the wax to relieve stress may be used. For example, a hot water spray schematically illustrated in FIG. 4 may be used. In this embodiment, the wafer and polishing block unit 16 is placed, wafer facing down, onto a spray bath 20. The spray bath includes a spray head 22 in fluid communication with a deionized water supply line 24. Deionized water from a source passes through a first solenoid valve 26 to the spray head. Deionized water also passes through a second solenoid valve 28 to a pair of hot water heaters 30. A control circuit, generally indicated at 32, operates the solenoid valves 26, 28 so that deionized water is fed to the spray head 22 selectively from the water heaters 30 or from the unheated supply line 24. In this instance, hot water is sprayed onto the front side of the wafer 14. The hot water is preferably at a temperature of between about 50° C. and 100° C., and is sprayed for a period of between about 10 and 60 seconds. Subsequent to re-heating, cold water is sprayed onto the front side of the wafer 14 to make certain that the wax re-hardens prior to being sent to the polisher. Other methods for heating the wafer and block unit 16 may be used without departing from the scope of the present invention. For instance, in addition to the spray bath embodiment, infrared heating units (not shown) could be employed.

After re-heating is completed to relieve stress in the wafer 14, the wafer and polishing block unit 16 are taken to a polisher (not shown). A suitable polishing treatment is disclosed in aforementioned U.S. Pat. No. 5,605,487. The front side of the wafer 14 is first rough polished at a relatively high rate of material removal, and then finished polished to form a highly reflective, damage free surface. The wafer and polishing block unit 16 are held by a polishing arm of a rough polisher against a rotating polishing pad. A slurry is applied to the pad which contains a chemically active agent and small particles for mechanical material removal. The rough polishing slurry preferably comprises a sodium hydroxide stabilized colloidal silica solution such as those commercially available from E. I. du Pont de Nemours & Company, Nalco Chemical Company (Naperville, Ill.) and Cabot Corporation (Tuscolo, Ill.). During delivery of the slurry, the semiconductor wafer 14 is preferably pressed against the rough polishing pad at a pressure in the range of 4–10 psi (more preferably 6–8 psi). The finish polishing slurry preferably comprises an ammonia stabilized colloidal solution such as those commercially available from Nalco Chemical Company and Fujimi Incorporated. The polishing arm of the finish polisher presses the wafer 14 against the pad with less force that the rough polisher. A softer polishing pad is also employed.

After polishing the wafer and block unit 16, the wafer 14 is separated ("demounted") from the block 10. It has been found that the release of the wafer 14 from the block 10 does not cause the edge ring to reappear at substantially its full original height on the front side of the wafer. In addition, raised bumps on the front surface, caused by laser marks on the back surface, which were present after conventional processing are also substantially reduced. It is believed that this is a result of the stress relief permitted by the present invention. As a result, a the front surface of the wafer 14 has a greater freedom from surface features which can detrimentally affect oxide layer uniformity and wafer surface flatness. The wafer is cleaned in a suitable manner and packaged for delivery to a device manufacturer.

In tests, line scans of wafers processed according to the method of the present invention were made using a CR83-SQM metrology tool (available from ADE Corporation of Westwood, Mass.). The line scans were made on the front side of the wafer 14, with the wafer oriented so that a flat (not shown) on the wafer was at the bottom. The measurements were made within 36 mm from the top of the wafer. The line scans show that the maximum average peak to valley measurements within the wavelength of 0.2 nm to 20 nm averaged about 46 nanometers for wafers processed according to the method of the present invention. This result is to be compared with an average of 90 nanometers for wafers polished according to conventional methods, without reheating the wax to relieve stress in the wafer. It is to be understood that the measured height of the features will vary depending upon the metrology device used. However, it may be said that the height of surface features on the nanotopology scale are improved by 30% to 50%.

Figure 2A:
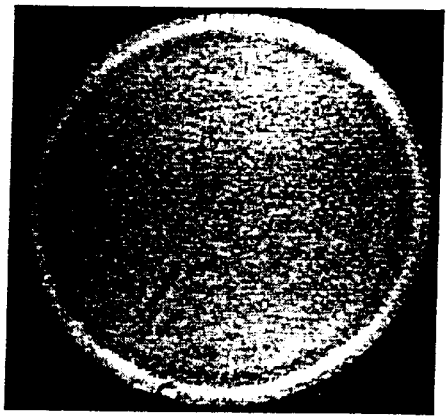
FIGS. 2A and 2B are magic mirror images of a wafer which has been conventionally wax mounted and polished and a wafer which has been wax mounted according to the present invention and polished.
Figure 2B:
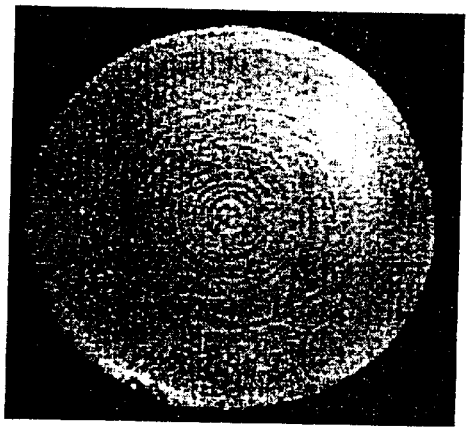
Figure 5A:
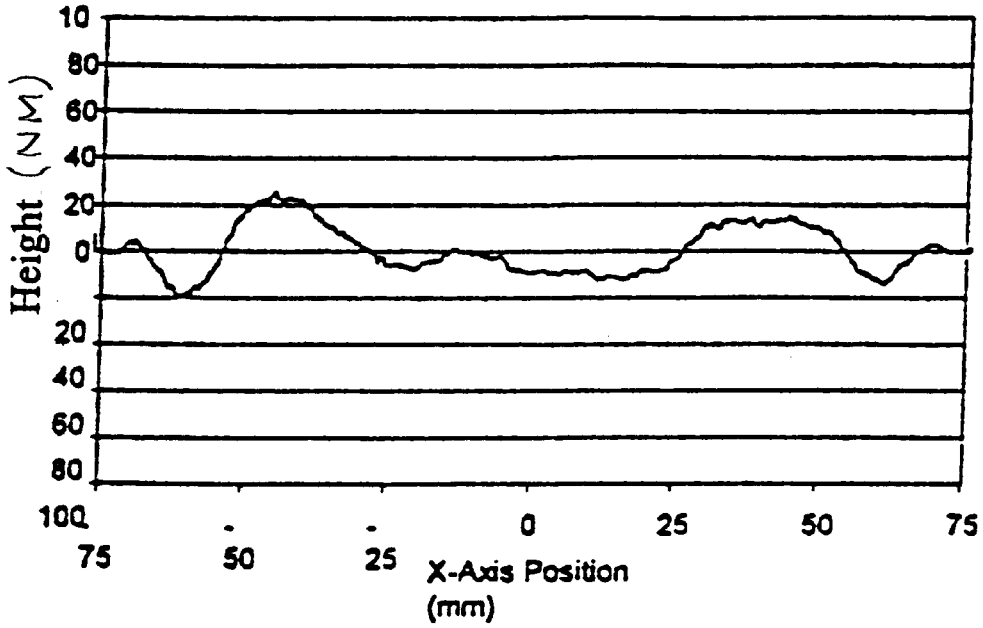
FIGS. 5A and 5B are line scans comparing flatness of the front side of wafers processed according to the present invention and according to a conventional process.
Figure 5B:
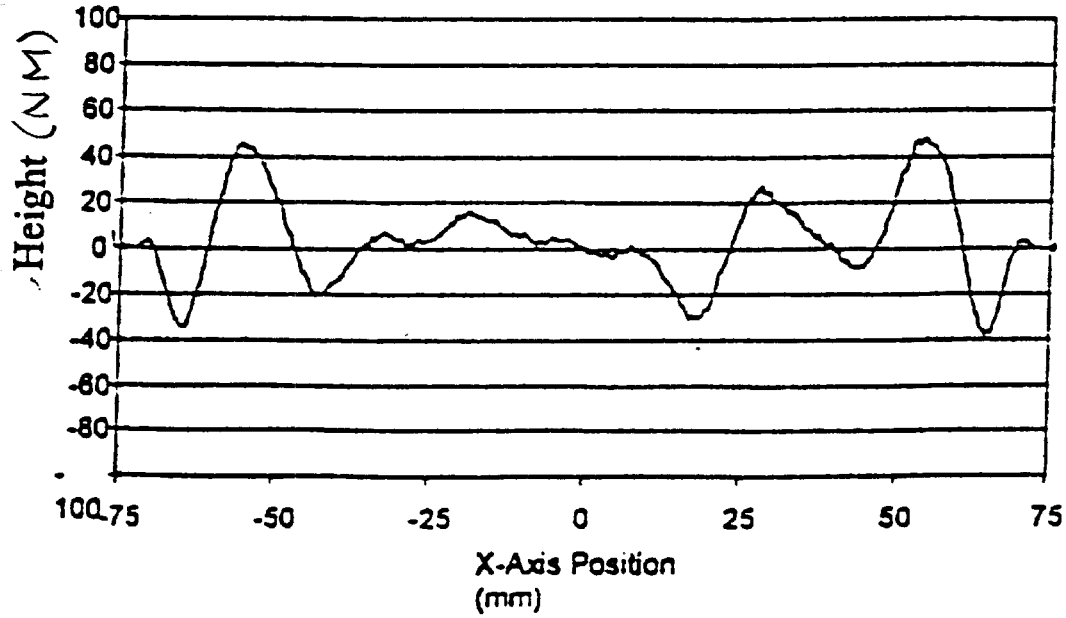

FIGS. 5A and 5B show graphs of line scans for wafers polished according to the method of the present invention (FIG. 5A) and according to conventional methods (FIG. 5B). It may be seen that the pronounced feature at the edges of the wafer is substantially reduced by the present invention. The conventionally polished wafer has a pronounced edge ring even after polishing, as evidenced by the dark and light rings at its periphery of FIG. 2A. However, the wafer polished according to the present invention is substantially free of an edge ring (FIG. 2B), as evidenced by the generally uniform lightness over its surface. Deformations left after polishing as a result of back side laser marks are not illustrated, but generally show up as dark dots on a magic mirror image of the front surface of the wafer. Tests have demonstrated that laser mark deformations are also substantially reduced by the present invention.

In view of the above, it will be seen that the several objects of the invention are achieved and other advantageous results obtained. The wafer produced according to the method of the present invention has a nanotopology with a markedly reduced number of front side surface features which negatively impact device manufacture. The absence of a substantial edge ring or front side bumps caused by laser marks permits the oxide layer thickness to remain substantially uniform even when CMP processes are employed in device manufacture.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A process of forming a semiconductor wafer which inhibits the formation of surface features of a nanotopology scale on a polished front side of the wafer, the process comprising the steps of:

slicing a wafer from an ingot of semiconductor material;

etching the wafer to remove damage from at least one side thereof;

applying wax in flowable form to a mounting surface of the polishing block;

pressing a back side of the semiconductor wafer into the wax on the polishing block to bond the wafer to the polishing block, the pressing of the wafer into the wax against the polishing block moving the wafer from a relaxed configuration to a deformed configuration;

prior to any polishing of the wafer as mounted on the polishing block, heating the wax bonding the wafer to the polishing block to a temperature of up to 95° C. and for a time selected to soften the wax and permit the wafer to move relative to the polishing block toward the relaxed configuration without breaking the bond of the wafer to the polishing block thereby to relieve stress in the wafer;

polishing the front side of the wafer as mounted on the polishing block by holding the polishing block and rubbing the front side of the wafer against a polishing pad in the presence of a polishing slurry;

removing the polished wafer from the polishing block; and cleaning the wafer.

2. A process of forming a semiconductor wafer according to claim 1 wherein said step of heating the wax comprises heating the wax for a period of between 5 and 300 seconds.

3. A process of forming a semiconductor wafer according to claim 2 wherein said step of heating the wax comprises heating the wax for a period of between 45 and 60 seconds.

4. A process of forming a semiconductor wafer according to claim 3 wherein said step of heating the wax comprises heating the wax for a period of about 50 seconds.

5. A process of forming a semiconductor wafer according to claim 4 wherein said step of heating the wax further includes heating the wax to a temperature of about 85° C.

6. A process of forming a semiconductor wafer according to claim 2 wherein said step of heating the wax includes heating the wax to a temperature of between 75° C. and 95° C.

7. A process of forming a semiconductor wafer according to claim 6 wherein said step of heating the wax includes heating the wax to a temperature of about 85° C.

8. A process of forming a semiconductor wafer according to claim 1 wherein said step of heating the wax bonding the wafer to the polishing block is done at atmospheric pressure.

9. A process of forming a semiconductor wafer according to claim 8 wherein said step of pressing the back side of the wafer into the wax on the polishing block is carried out at vacuum pressure, and wherein no heat is applied to the wafer, wax or block at vacuum pressure.

10. A process of forming a semiconductor wafer according to claim 8 further comprising the step, prior to said step of pressing the wafer into the wax, of heating the polishing block and wax applied thereto.

11. A process of forming a semiconductor wafer according to claim 1 further comprising the step of forming laser marks on the back side of the wafer.

12. A process of forming a semiconductor wafer which inhibits the formation of surface features of a nanotopology scale on a polished front side of the wafer, the process comprising the steps of:

slicing a wafer from an ingot of semiconductor material;

applying wax in flowable form to a mounting surface of the polishing block;

pressing a back side of the semiconductor wafer into the wax on the polishing block to bond the wafer to the polishing block, the pressing of the wafer into the wax against the polishing block moving the wafer from a relaxed configuration to a deformed configuration;

prior to any polishing of the wafer as mounted on the polishing block, heating the wax bonding the wafer to the polishing block to a temperature of up to 95° C. and for a time selected to soften the wax and permit the wafer to move relative to the polishing block toward the relaxed configuration without breaking the bond of the wafer to the polishing block thereby to relieve stress in the wafer;

polishing the front side of the wafer as mounted on the polishing block by holding the polishing block and rubbing the front side of the wafer against a polishing pad in the presence of a polishing slurry;

removing the polished wafer from the polishing block; and cleaning the wafer.

13. A process of forming a semiconductor wafer according to claim 12 wherein said step of heating the wax comprises heating the wax for a period of between 5 and 300 seconds.

14. A process of forming a semiconductor wafer according to claim 13 wherein said step of heating the wax bonding the wafer to the polishing block comprises heating the wax for a period of between 45 and 60 seconds.

15. A process of forming a semiconductor wafer according to claim 14 wherein said step of heating the wax comprises heating the wax for a period of about 50 seconds.

16. A process of forming a semiconductor wafer according to claim 15 wherein said step of heating the wax further includes heating the wax to a temperature of about 85° C.

17. A process of forming a semiconductor wafer according to claim 13 wherein said step of heating the wax includes heating the wax to a temperature of between 75° C. and 95° C.

18. A process of forming a semiconductor wafer according to claim 17 wherein said step of heating the wax includes heating the wax to a temperature of about 85° C.

19. A process of forming a semiconductor wafer according to claim 12 wherein said step of heating the wax is done at atmospheric pressure.

20. A process of forming a semiconductor wafer according to claim 19 wherein said step of pressing the back side of the wafer into the wax on the polishing block is carried out at vacuum pressure, and wherein no heat is applied to the wafer, wax or block at vacuum pressure.

21. A process of forming a semiconductor wafer according to claim 19 further comprising the step, prior to said step of pressing the wafer into the wax, of heating the polishing block and wax applied thereto.

22. A process as set forth in claim 12 further comprising the step of forming a laser mark on the back side of the wafer.

23. A process as set forth in claim 12 wherein the front side of the wafer is the only side of the wafer which is polished.

24. A process as set forth in claim 12 wherein said step of pressing the wafer into the wax is carried out in a vacuum pressure environment.

25. A process as set forth in claim 1 wherein said step of pressing the wafer into the wax is carried out in a vacuum pressure environment.

26. A process of forming a semiconductor wafer which inhibits the formation of surface features of a nanotopology scale on a polished front side of the wafer, the process comprising the steps of:

slicing a wafer from an ingot of semiconductor material;

applying wax in flowable form to a mounting surface of the polishing block;

pressing a back side of the semiconductor wafer into the wax on the polishing block to bond the wafer to the polishing block, the pressing of the wafer into the wax against the polishing block moving the wafer from a relaxed configuration to a deformed configuration;

prior to any polishing of the wafer as mounted on the polishing block, heating the wax bonding the wafer to the polishing block to a temperature and for a period of between 10 and 90 seconds selected to soften the wax and permit the wafer to move relative to the polishing block toward the relaxed configuration without breaking the bond of the wafer to the polishing block thereby to relieve stress in the wafer;

polishing the front side of the wafer as mounted on the polishing block by holding the polishing block and rubbing the front side of the wafer against a polishing pad in the presence of a polishing slurry;

removing the polished wafer from the polishing block; and cleaning the wafer.

27. A process of forming a semiconductor wafer according to claim 26 wherein said step of heating the wax bonding the wafer to the polishing block comprises heating the wax for a period of between 45 and 60 seconds.

28. A process of forming a semiconductor wafer according to claim 27 wherein said step of heating the wax comprises heating the wax for a period of about 50 seconds.

29. A process of forming a semiconductor wafer according to claim 28 wherein said step of heating the wax further includes heating the wax to a temperature of about 85° C.

30. A process of forming a semiconductor wafer according to claim 26 wherein said step of heating the wax includes heating the wax to a temperature of between 75° C. and 95° C.

31. A process of forming a semiconductor wafer according to claim 30 wherein said step of heating the wax includes heating the wax to a temperature of about 85° C.

32. A process of forming a semiconductor wafer according to claim 26 wherein said step of heating the wax is done at atmospheric pressure.

33. A process of forming a semiconductor wafer according to claim 32 wherein said step of pressing the back side of the wafer into the wax on the polishing block is carried out at vacuum pressure, and wherein no heat is applied to the wafer, wax or block at vacuum pressure.

34. A process of forming a semiconductor wafer according to claim 32 further comprising the step, prior to said step of pressing the wafer into the wax, of heating the polishing block and wax applied thereto.

35. A process as set forth in claim 26 further comprising the step of forming a laser mark on the back side of the wafer.

36. A process as set forth in claim 26 wherein the front side of the wafer is the only side of the wafer which is polished.

37. A process as set forth in claim 26 wherein said step of pressing the wafer into the wax is carried out in a vacuum pressure environment.

* * * * *